US008066356B2

(12) United States Patent
Lee et al.

(10) Patent No.: US 8,066,356 B2
(45) Date of Patent: Nov. 29, 2011

(54) THERMAL INKJET PRINT HEAD

(75) Inventors: Moon-chul Lee, Seongnam-si (KR); Yong-seop Yoon, Seoul (KR); Yong-won Jeong, Seoul (KR); Dong-sik Shim, Hwaseong-si (KR); Sung-joon Park, Suwon-si (KR); Jong-seok Kim, Hwanseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 396 days.

(21) Appl. No.: 12/209,775

(22) Filed: Sep. 12, 2008

(65) Prior Publication Data

US 2009/0267990 A1 Oct. 29, 2009

(30) Foreign Application Priority Data

Apr. 29, 2008 (KR) ..... 10-2008-0039840

(51) Int. Cl.
*B41J 2/05* (2006.01)
*B41J 2/04* (2006.01)

(52) U.S. Cl. ..... 347/65; 347/54

(58) Field of Classification Search ..... 347/54, 347/61, 62, 64, 65

See application file for complete search history.

(56) References Cited

U.S. PATENT DOCUMENTS 5,883,650 A * 3/1999 Figueredo et al. ..... 347/62
6,409,312 B1 * 6/2002 Mrvos et al. ..... 347/54
2003/0117462 A1 * 6/2003 Cleland et al. ..... 347/65

FOREIGN PATENT DOCUMENTS

KR 10-2002-0025588 4/2002

OTHER PUBLICATIONS

English language abstract of KR 10-2002-0025588, published Apr. 4, 2002.

* cited by examiner

*Primary Examiner* — Geoffrey Mruk
(74) *Attorney, Agent, or Firm* — Staas & Halsey LLP

(57) ABSTRACT

A thermal inkjet printhead is provided including a substrate, and a chamber layer, which is stacked on the substrate. The chamber layer includes an ink chamber that is filled with ink supplied from an ink feed hole. The printhead includes a heater inside the ink chamber that heats the ink, an island, which is formed on the substrate at an ink inlet port of the ink chamber, and a nozzle layer, which is stacked on the chamber layer, including a nozzle for ejecting the ink. The walls of the ink chamber and the island that face each other are symmetrical with respect to the center of the nozzle.

13 Claims, 7 Drawing Sheets

THERMAL INKJET PRINT HEAD

CROSS-REFERENCE TO RELATED PATENT APPLICATION

This application claims the benefit of Korean Patent Application No. 10-2008-0039840, filed on Apr. 29, 2008, in the Korean Intellectual Property Office, the disclosure of which is incorporated herein in its entirety by reference.

BACKGROUND OF THE INVENTION

1. Field of the Invention

The present invention relates to an inkjet printer, and more particularly, to a thermal inkjet printhead having an improved ejection property and stable structure.

2. Description of the Related Art

In general, inkjet printers are devices that eject ink droplets from an inkjet printhead onto desired positions of a printing medium in order to form an image of certain color. Examples of such inkjet printers include a shuttle type inkjet printer and a line printing type inkjet printer. A shuttle type inkjet printer performs a printing operation by reciprocating an inkjet printhead along a transfer direction perpendicular to the direction of travel of the printing medium. A line printing type inkjet printer on the other hand may achieve higher printing speed by utilizing an array of printheads that spans the width of the printing medium. A line printing type inkjet printer performs a printing operation by moving the printing medium past the stationary printhead array.

Inkjet printheads themselves may be broadly categorized according to their ink ejection mechanism into two types, a thermal type inkjet print head and a piezoelectric type inkjet printhead: A thermal inkjet printhead ejects the ink droplets due to the thermal expansion of ink bubbles while a piezoelectric inkjet printhead ejects ink droplets due to the pressure applied to ink by deformation of a piezoelectric body.

For example, in a thermal inkjet printhead, when a pulse current is supplied to a heater including a heating resistor, the heater generates heat causing the ink near the heater to be instantaneously heated up to approximately 300° C., thereby making the ink boil. The boiling ink evaporates, producing ink bubbles, which continue to expand to exert pressure on the ink filled in an ink chamber. As a result, ink around a nozzle is ejected from the ink chamber in the form of droplets through the nozzle. Such a thermal inkjet printhead generally has a structure that includes a chamber layer and a nozzle layer sequentially stacked on a substrate. An ink feed hole for supplying ink is formed in the substrate, and an ink chamber filled with ink to be ejected is formed in the chamber layer. In addition, a plurality of nozzles through which to eject ink is formed on the nozzle layer.

A trajectory error with respect to an ink droplet can occur, for example, due to a missing nozzle or due to variations in ejection characteristics of the nozzles in the inkjet printhead. A trajectory error can be compensated somewhat in a shuttle type inkjet printer by software-based correction or motion correction of the inkjet printhead since the inkjet printhead of the shuttle type inkjet printer performs a printing operation by moving the printhead. However, the effect of a trajectory error on printing quality may be exacerbated in a line printing type inkjet printer of higher printing speed since in a line printing type inkjet printer the printing operation is performed while moving the printing medium with the array printhead remains stationary. Accordingly, an inkjet printhead having a structure capable of addressing trajectory errors of ink droplets is desirable.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF THE INVENTION

Figure 1:
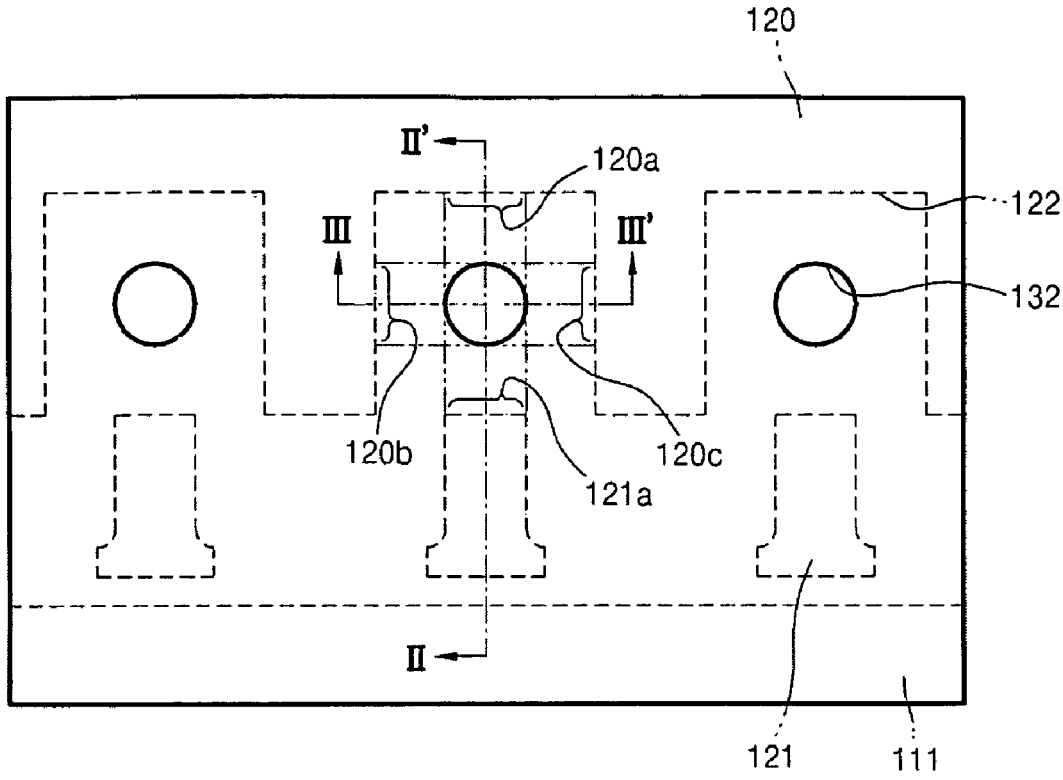
FIG. 1 is a plan view illustrating an inkjet printhead according to an embodiment of the present invention.

Reference will now be made in detail to embodiments of the present invention, examples of which are illustrated in the accompanying drawings, wherein like reference numerals refer to like elements throughout. While the embodiment are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale, and may be exaggerated for the sake of allowing greater understanding. Furthermore, it should be understood that when a layer is referred to as being "on" another layer or substrate, it can be directly on the other layer or substrate, or intervening layers may also be present.

Figure 2:
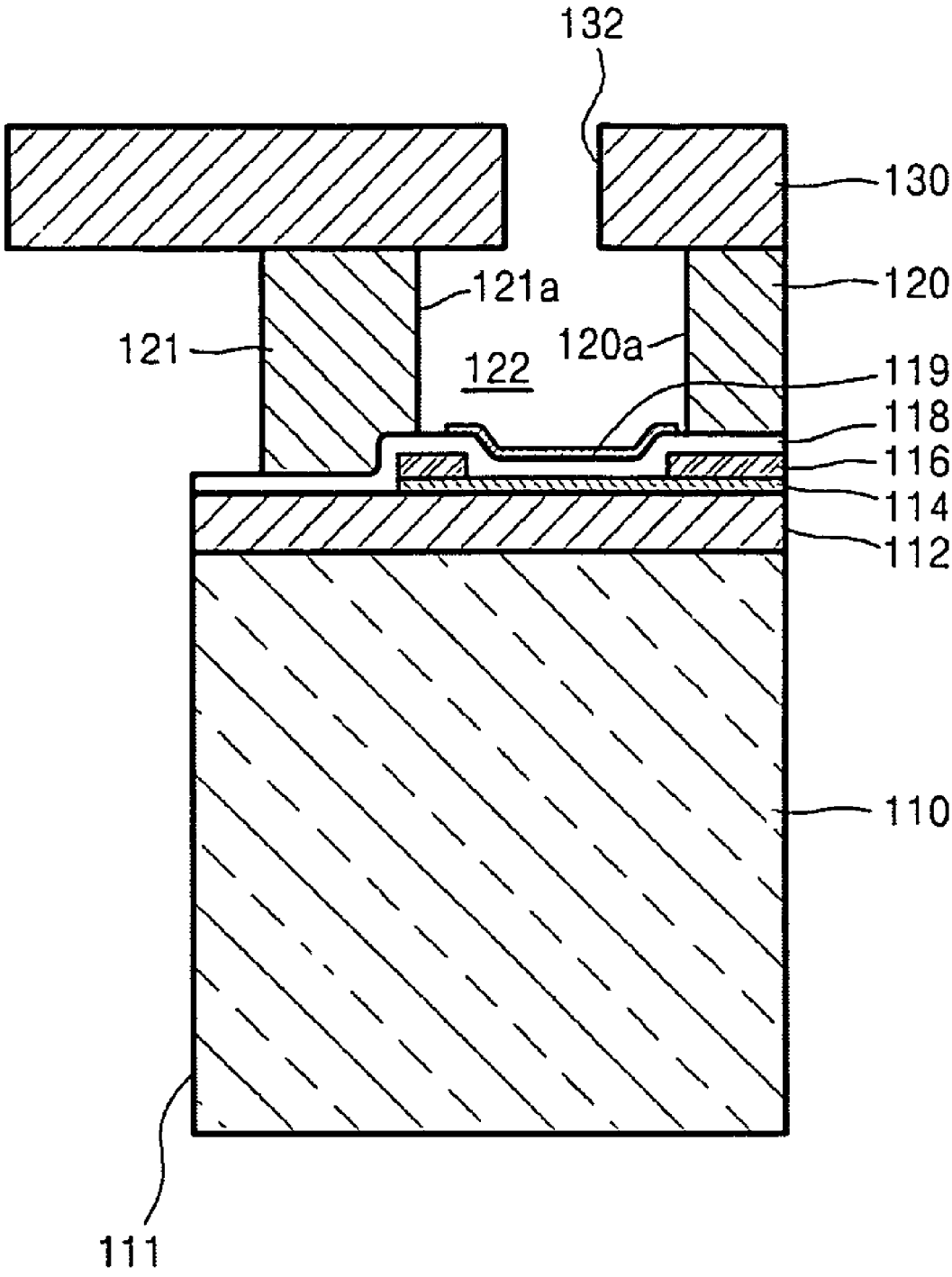
FIG. 2 is a cross-sectional view taken along line II-II' of FIG. 1.

FIG. 1 is a plan view illustrating a thermal inkjet printhead according to an embodiment. FIG. 2 is a cross-sectional view taken along line II-II' of FIG. 1 and FIG. 3 is a cross-sectional view taken along line III-III' of FIG. 1.

Figure 3:
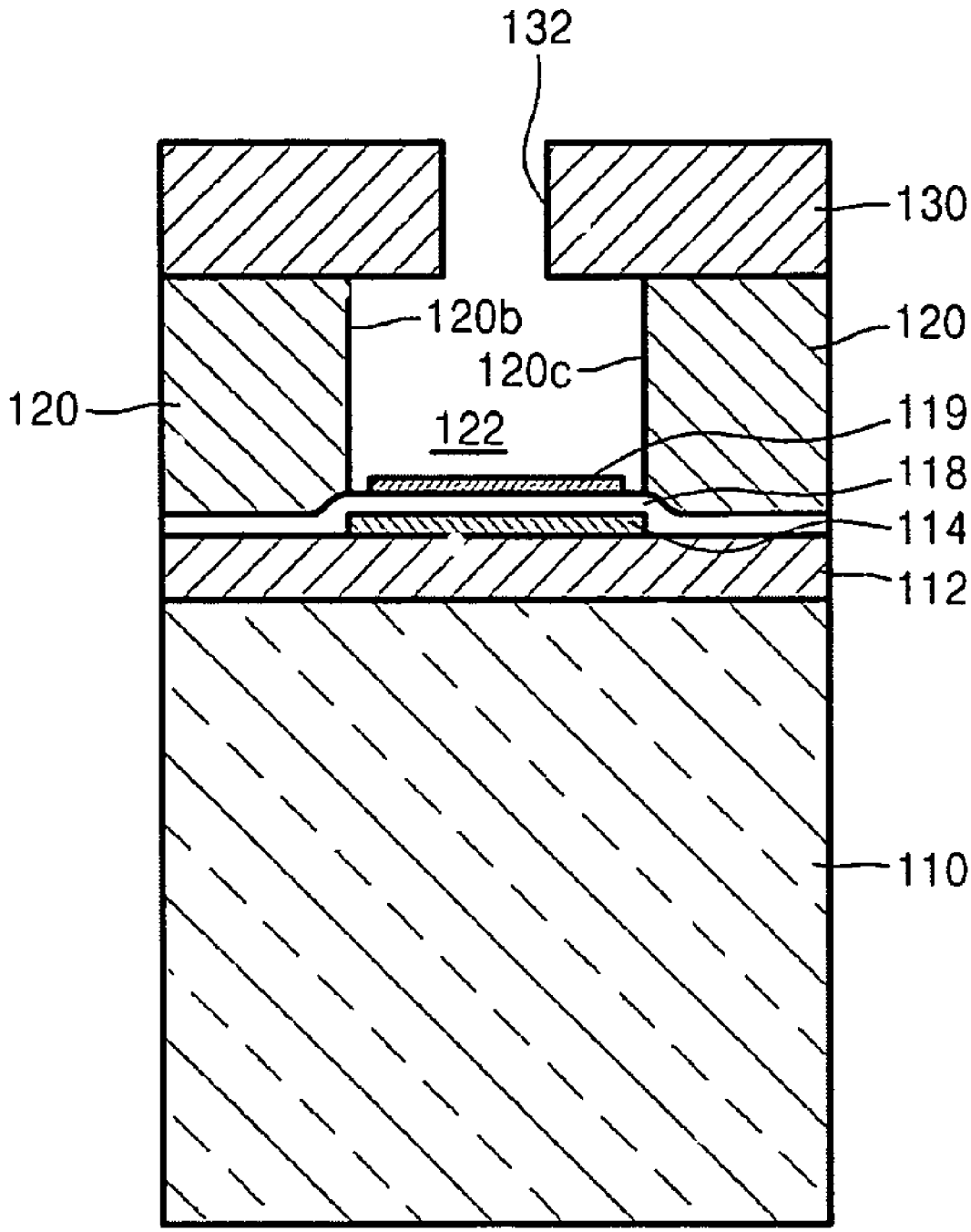
FIG. 3 is a cross-sectional view taken along line III-III' of FIG. 1.

Referring to FIGS. 1 through 3, the inkjet printhead according to an embodiment may include a substrate 110, including a plurality of material layers, a chamber layer 120, stacked on the substrate 110, and a nozzle layer 130, stacked on the chamber layer 120. According to an embodiment, the substrate 110 may be formed of silicon. Also, an ink feed hole 111 for supplying ink is formed through the substrate 110.

An insulation layer 112 for providing insulation and/or isolation between the substrate 110 and a heater 114 may be formed on the substrate 110. For example, the insulation layer 112 may be formed of a silicon oxide. The heater 114 for generating bubbles by heating ink inside the ink chamber 122 mat be formed on the insulation layer 112. The heater 114 may be prepared on the bottom surface of the ink chamber 122. The heater 114 may be formed of a heating resistor. Examples of such a heating resistor include tantalum-aluminum alloy, tantalum nitride, titanium nitride, tungsten silicide, or the like. An electrode 116 may be formed on the top surface of the heater 114. The electrode 116 supplies current to the heater 114, and may be formed of a material having high electric conductivity. For example, the electrode 116 may be formed of aluminum (Al), an aluminum alloy, gold (Au), silver (Ag), or the like.

A passivation layer 118 may be formed on the top surface of the heater 114 and the electrode 116. The passivation layer 118 is used to prevent the heater 114 and the electrode 116 from being oxidized or corroded by coming into contact with the ink. For example, a passivation layer may be formed of silicon nitride or silicon oxide, or the like. Also, an anti-cavitation layer 119 may be formed on the top surface of the passivation layer 118. The anti-cavitation layer 119 may serve to protect the heater 114 from a cavitation force that can result from the bursting of the bubbles. For example, the anti-cavitation layer 119 may be formed of tantalum (Ta).

The chamber layer 120 may be stacked on the passivation layer 118. The ink chamber 122 that is to be filled with ink supplied from the ink feed hole 111 is formed in the chamber layer 120. An island 121 having a predetermined size may be formed on an ink inlet port of the ink chamber 122, and over the passivation layer 118. Accordingly, the ink inside the ink feed hole 111 flows into the ink chamber 122 through a path between the chamber layer 120 and the island 121. The island 121 may have the same height as the chamber layer 120. The island 121 removes impurities in the ink supplied to the ink chamber 122 from the ink feed hole 111, and may support the nozzle layer 130. The chamber layer 120 and the island 121 may be formed of a polymer based material.

The nozzle layer 130 is stacked on the chamber layer 120. A nozzle 132 that ejects the ink is formed in the nozzle layer 130. The nozzle 132 is located on the ink chamber 122. The nozzle layer 130 may be formed of a polymer based material.

In the above structure, the ink from the ink feed hole 111 may be supplied to the ink chamber 122 through a path between the island 121 and the chamber layer 120, arid the ink inside the ink chamber 122 is ejected as a droplet to the outside via the nozzle 132 by being heated by the heater 114. A direction of the ink flowing into the ink chamber 122 and a direction of the ink ejecting from the ink chamber 122 via the nozzle 132 may be perpendicular to each other.

In the inkjet printhead according to an embodiment, the walls of the ink chamber 122 that face each other in a first direction (for example, a direction parallel to the ink feed hole 111) around the nozzle 132 may be symmetrically formed with respect to the center line of the nozzle 132. For example, parts 120*b* and 120*c* of the walls of the ink chamber 122 facing each other in the first direction that correspond to the size of the nozzle 132 may be symmetrically formed with respect to the center line of the nozzle 132. The parts 120*b* and 120*c* may, for example, be flat surfaces. Also, a wall of the ink chamber 122 and a wall of the island 121 that face each other in a second direction (for example, a direction perpendicular to the first direction) around the nozzle 132 may be symmetrically formed with respect to the center line of the nozzle 132. For example, the part 120*a* of the wall of the ink chamber 122 and the part 121*a* of the wall of the island 121 that face each other in the second direction, and that correspond to the size of the nozzle 132, may be symmetrically formed with respect to the nozzle 132. The part 120*a* of the ink chamber 122 and the part 121*a* of the island 121 may, for example, be flat surfaces.

The distance between the parts 120*b* and 120*c* may be equal to the distance between the parts 120*a* and 121*a*. By forming the parts 120*b* and 120*c* symmetrically with respect to the center line of the nozzle 132, and forming the parts 120*a* and 121*a* symmetrically with respect to the center line of the nozzle 132, changes in a modified angle of the nozzle layer 130 during manufacturing of the inkjet printhead may be reduced, and thus may result in an improved ink ejection characteristic and a stable structure.

Figure 4:
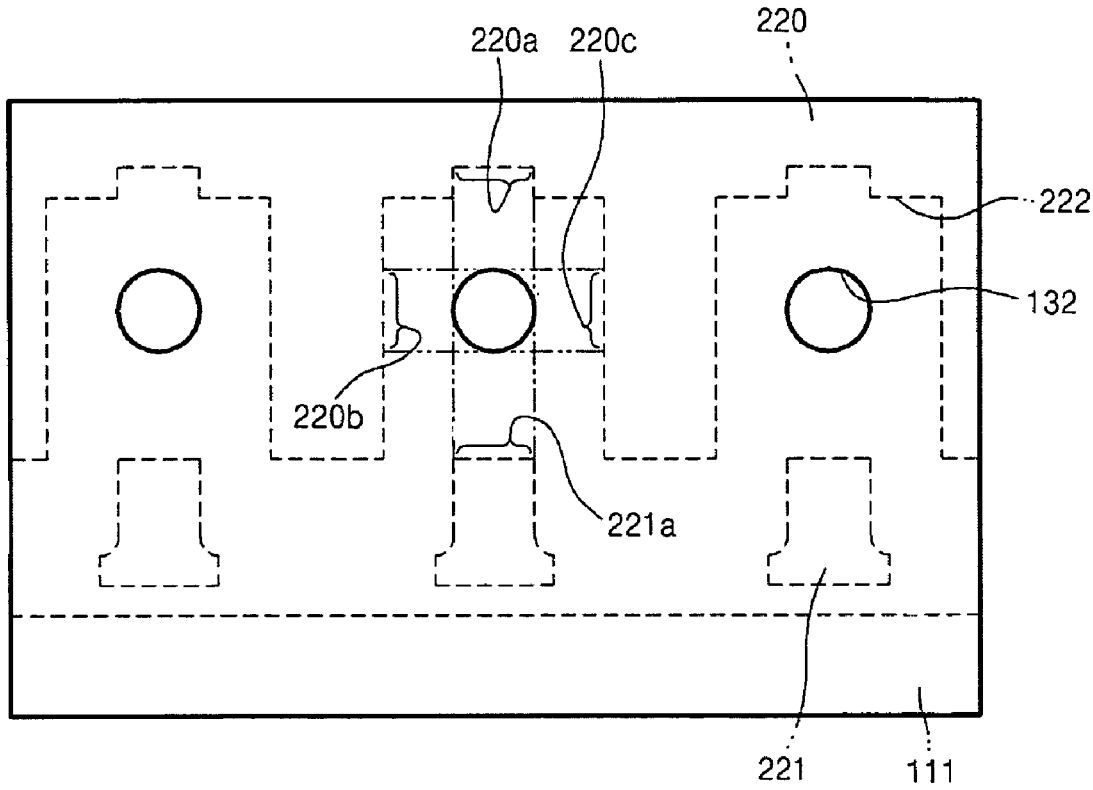
FIG. 4 is a plan view illustrating an inkjet printhead according to another embodiment of the present invention.

FIG. 4 is a plan view illustrating an inkjet printhead according to another embodiment. Detailed descriptions of those features, structures and/or configurations commonly shared with the embodiments previously described may not be repeated in the following description. Referring to FIG. 4, as with the previous embodiments, the walls of the ink chamber 222 that face each other in the first direction (for example, the direction parallel to the ink feed hole 111) around the nozzle 132 may be symmetrically formed with respect to the center line of the nozzle 132. For example, parts 220*b* and 220*c*, corresponding to the size of the nozzle 132, of the walls of the ink chamber 222 that face each other in the first direction may be symmetrically formed with respect to the nozzle 132. The wall of the ink chamber 222 and the wall of the island 221 that face each other in the second direction (for example, the direction perpendicular to the first direction) around the nozzle 132 may be symmetrically formed with respect to the nozzle 132. For example, parts 220*a* and 221*a*, corresponding to the size of the nozzle 132, of the wall of the ink chamber 222 and the wall of the island 221, respectively, that face each other in the second direction may be symmetrically formed with respect to the center line of the nozzle 132. The distance between the parts 220*b* and 220*c* however may be different from the distance between the parts 220*a* and 221*a*. For example, the distance between the parts 220*b* and 220*c* may be smaller than the distance between the parts 220*a* and 221*a*. Alternatively, in another example, the distance between the parts 220*b* and 220*c* may be larger than the distance between the parts 220*a* and 221*a*.

Figure 5A:
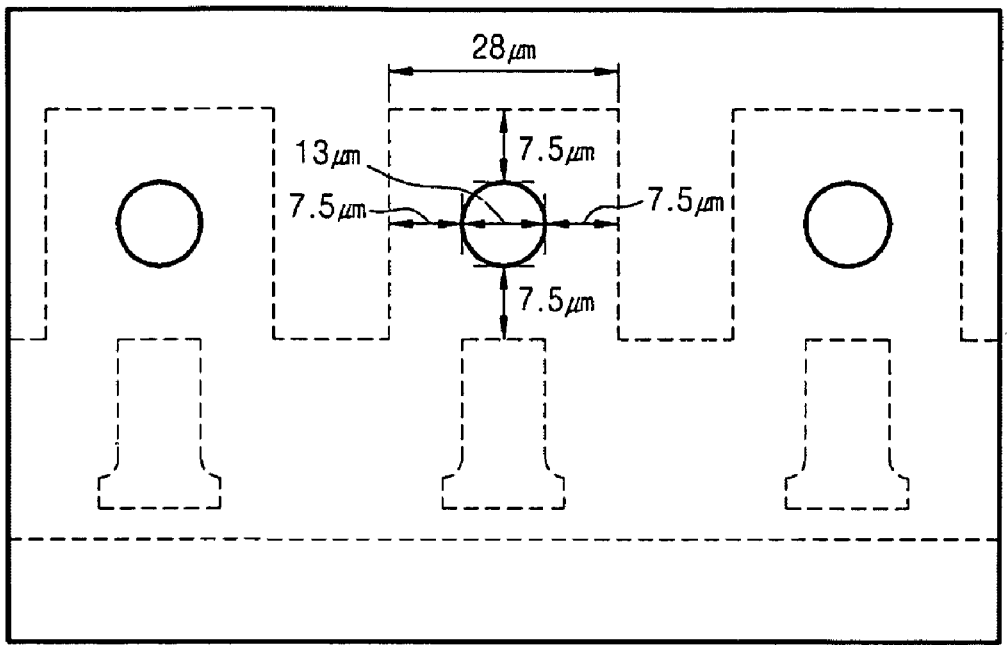
FIGS. 5A through 5D are diagrams illustrating several different models of inkjet printhead to measure the extent of deformation of the nozzle layer during manufacturing processes.
Figure 5B:
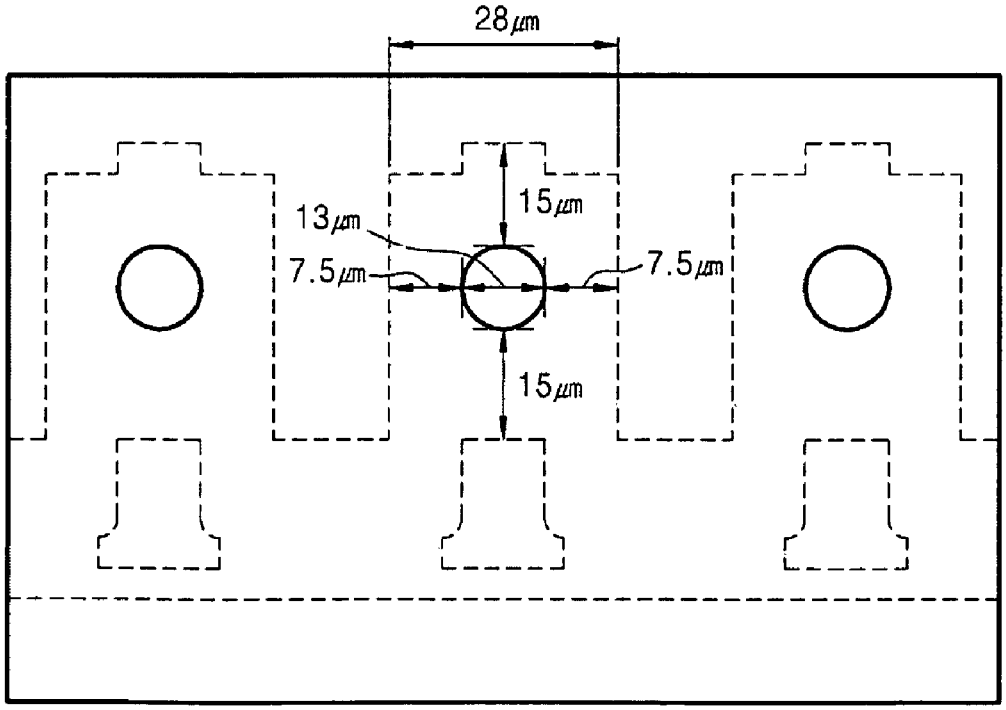
Figure 5C:
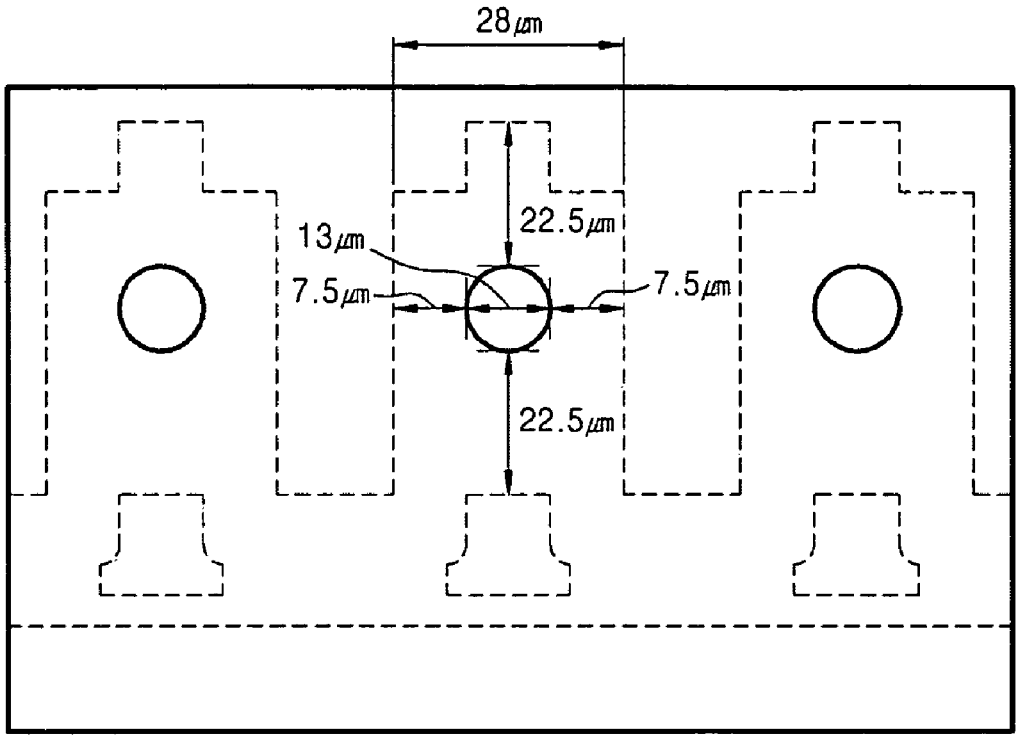
Figure 5D:
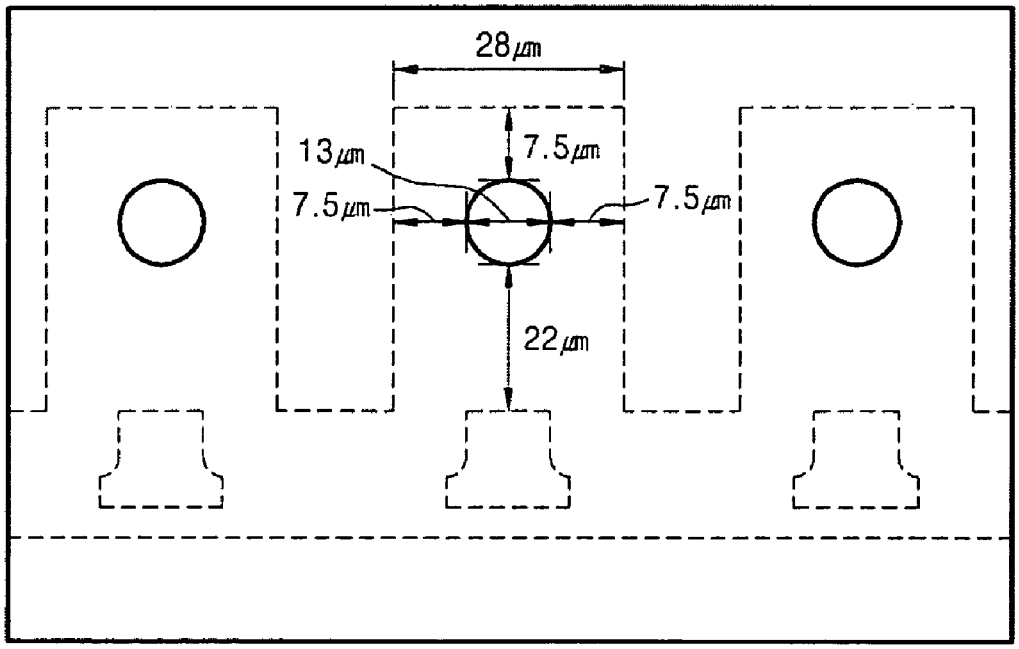

FIGS. 5A through 5D are diagrams respectively illustrating different inkjet printheads models 1 through 4 prepared to measure the deformation of the nozzle layer occurring during several manufacturing process steps. Models 1 through 3 respectively illustrated in FIGS. 5A through 5C are models of an inkjet printhead according different alternative embodiments of the present invention. In particular, in the model 1 illustrated in FIG. 5A, the distance between the walls of the ink chamber that face each other is equal to the distance between the wall of the ink chamber and the wall of the island that face each other. In the models 2 and 3 respectively illustrated in FIGS. 5B and 5C, the distance between the walls of the ink chamber that face each other is smaller than the distance between the wall of the ink chamber and the wall of the island that face each other. FIG. 5D illustrates the model 4, in which the wall of the ink chamber and the wall of the island that face each other are asymmetrically formed with respect to the center line of the nozzle. For examples in the model 4 illustrated in FIG. 5D, looking at the wall of the ink chamber and the wall of the island that face each other, it can be seen that the distance between the wall of the ink chamber and the nozzle is smaller than the distance between the wall of the island and the nozzle.

Each of the models 1 through 4 are fabricated, and the variation of the angle of the nozzle layer caused during each manufacturing process is measured. The following processes are performed in order to manufacture the inkjet printheads illustrated in FIGS. 5A through 5D. After stacking a chamber layer including the ink chamber on a substrate, a sacrificial layer is formed that fills the ink chamber 122. Next, a nozzle layer is formed on the top surfaces of the sacrificial layer and the chamber layer, exposure and development processes are performed, and the nozzle is formed by baking the nozzle layer. Then, the sacrificial layer filling the ink chamber 122 is removed, and a final baking process is performed.

Figure 6:
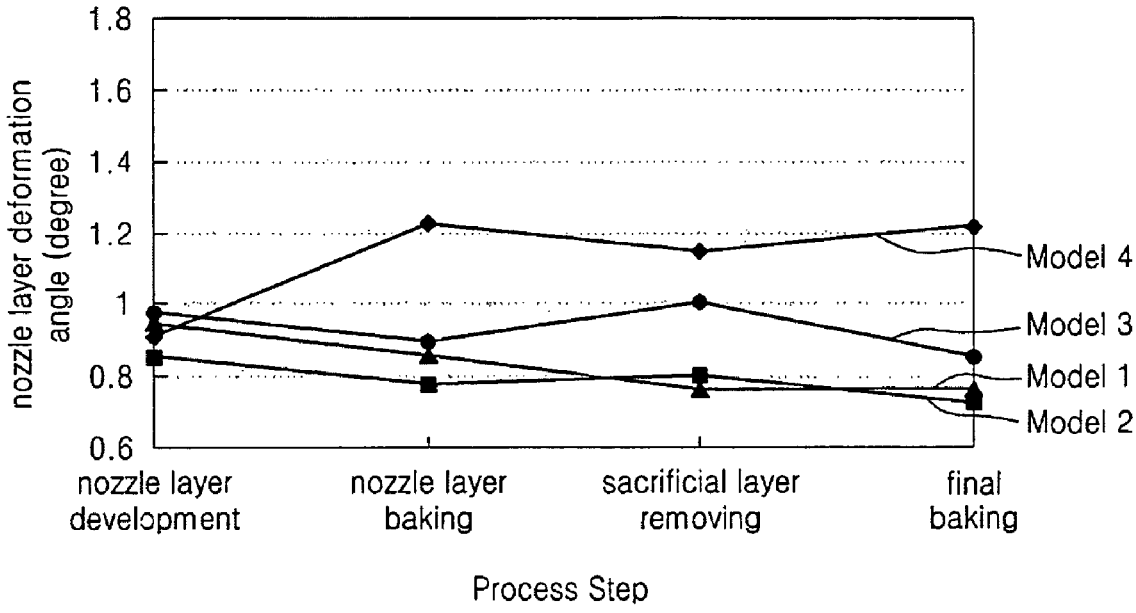
FIG. 6 is a graph plotting the deformation of the nozzle layers of the models illustrated in FIGS. 5A through 5D.

FIG. 6 is a graph plotting the deformation angle of the nozzle layer of the models 1 through 4 of the inkjet printhead illustrated in FIGS. 5A through 5D resulting during the manufacturing processes. As illustrated in FIG. 6, the deformation angles of the nozzle layer are measured after each of a nozzle layer development process, a nozzle layer baking process, a sacrificial layer removing process, and a final backing process. Referring to FIG. 6, the degree of deformation of the nozzle layer of the models 1 through 3 is smaller than that of the model 4, in which the wall of the ink chamber and the wall of the island are asymmetrically formed with respect to the center line of the nozzle. When the deformation of the nozzle layer during the manufacturing processes is reduced, the ink ejection characteristic of the nozzle may be improved, and an inkjet printhead having a stable structure can be realized.

As described above, according to the inkjet printhead of the present invention, an ink ejection characteristic can be improved and a stable structure can be realized by forming the walls of the ink chamber that face each other symmetrically with respect to the center line of the nozzle and by forming the wall of the ink chamber and the wall of an island that face each other symmetrically with respect to the center line of the nozzle. In addition, the ejection characteristics of a plurality of inkjet printheads can be made uniform even when the inkjet printheads are formed from a plurality of silicon wafers.

Although certain embodiments of the present invention have been shown and described with particular details, those skilled in the art can appreciate that changes may be made to these embodiments without departing from the principles and spirit of them invention, the scope of which is defined in the claims and their equivalents.

What is claimed is:

1. An inkjet printhead, comprising:

a chamber layer formed above a substrate, the chamber layer including an, ink chamber configured accommodate an amount of ink, the ink chamber including a first and second side wall facing each other along a first direction, the ink chamber further including a third side wall;

an island formed above the substrate and in the chamber layer, the island including an island side wall facing the third side wall of the ink chamber along a second direction substantially perpendicular to the first direction; and a nozzle layer formed above the chamber layer, the nozzle layer including a nozzle through which the ink from the ink chamber is ejected, wherein the first and second side walls are symmetrical about the center of the nozzle along their entire length along the second direction, and the third side wall and the island side wall are symmetrical about the center of the nozzle along their entire length along the first direction.

2. The inkjet printhead of claim 1, wherein the substrate comprises an ink feed hole for supplying ink to the ink chamber, and the inkjet printhead further comprises a heater provided in the ink chamber, the heater being configured to heat the ink in the ink chamber.

3. The inkjet printhead of claim 2, wherein the island is formed proximate to an ink inlet port of the ink chamber through which the ink is received into the ink chamber from the ink feed hole.

4. The inkjet printhead of claim 2, wherein the heater comprises a heating resistor formed near a bottom of the ink chamber.

5. The inkjet printhead of claim 2, wherein a passivation layer is formed on the heater.

6. The inkjet printhead of claim 5, wherein the passivation layer is formed of silicon oxide.

7. The inkjet printhead of claim 5, wherein an anti-cavitation layer is formed over the passivation layer so as to protect the heater from forces generated by bursting of ink bubbles in the ink chamber.

8. The inkjet printhead of claim 7, wherein the anti-cavitation layer is formed of tantalum.

9. The inkjet printhead of claim 1, wherein the ink flows into the ink chamber in a third direction perpendicular to a fourth direction along which the ink is ejected from the ink chamber through the nozzle.

10. The inkjet printhead of claim 1, wherein a first distance between the first side wall and the second side wall is different from a second distance between the third side wall and the island side wall.

11. The inkjet printhead of claim 1, wherein each of the first, second, third side walls and the island side wall comprises a flat surface.

12. The inkjet printhead of claim 1, wherein each of the nozzle layer, the chamber layer and the island is formed of a polymer based material.

13. An inkjet printhead, comprising;

a chamber layer formed above a substrate, the chamber layer including an, ink chamber configured accommodate an amount of ink, the ink chamber including a first and second side wall facing each other along a first direction, the ink chamber further including a third side wall;

an island formed above the substrate and in the chamber layer, the island including an island side wall facing the third side wall of the ink chamber along a second direction substantially perpendicular to the first direction; and a nozzle layer formed above the chamber layer, the nozzle layer including a nozzle through which the ink from the ink chamber is ejected, wherein at least a portion of the first side wall corresponding to the nozzle and at least a portion of the second side wall corresponding to the nozzle are symmetrical about a center of the nozzle, and at least a portion of the third side wall corresponding to the nozzle and at least a portion of the island side wall corresponding to the nozzle are symmetrical about the center of the nozzle, and wherein a first distance between the first side wall and the second side wall is equal to a second distance between the third side wall and the island side wall.

* * * * *

UNITED STATES PATENT AND TRADEMARK OFFICE

CERTIFICATE OF CORRECTION

PATENT NO. : 8,066,356 B2
APPLICATION NO. : 12/209775
DATED : November 29, 2011
INVENTOR(S) : Moon-Chul Lee et al.

It is certified that error appears in the above-identified patent and that said Letters Patent is hereby corrected as shown below:

First Page Column 1 Item 75 (Inventors), Line 6, Delete "Hwanseong-si" and insert -- Hwaseong-si --, therefor.

Column 6, Line 33, in Claim 13, delete "comprising;" and insert -- comprising: --, therefor.

Signed and Sealed this
Sixth Day of March, 2012

David J. Kappos

David J. Kappos
*Director of the United States Patent and Trademark Office*